US005774855A

United States Patent [19]

Foti et al.

[11] Patent Number: 5,774,855

[45] Date of Patent: Jun. 30, 1998

[54] METHOD OF SPEECH SYNTHESIS BY MEANS OF CONCENTRATION AND PARTIAL OVERLAPPING OF WAVEFORMS

[75] Inventors: Enzo Foti; Luciano Nebbia; Stefano Sandri, all of Turin, Italy

[73] Assignee: CSELT-Centro Studi e Laboratori Tellecomunicazioni S.p.A., Turin, Italy

[21] Appl. No.: 528,713

[22] Filed: Sep. 15, 1995

[30] Foreign Application Priority Data

Sep. 29, 1994 [IT] Italy ..... TO94A0756

[51] Int. Cl.[6] ..... G10L 9/12

[52] U.S. Cl. ..... 704/267; 704/218

[58] Field of Search ..... 395/2.76, 2.77, 395/2.94, 2.22, 2.2, 2.16, 2.18, 2.7, 2.95, 2.91, 2.92, 2.87, 2.3, 2.32, 2.28; 704/267, 268, 503, 213, 211, 207, 209, 261, 286, 282, 283, 278, 221, 223, 219, 260, 253

[56] References Cited

U.S. PATENT DOCUMENTS

| | | | |
|---|---|---|---|
| 3,649,765 | 3/1972 | Rabiner et al. | 395/2.18 |
| 3,803,363 | 4/1974 | Lee | 375/240 |
| 3,940,565 | 2/1976 | Lindenberg | 395/2.62 |
| 4,214,125 | 7/1980 | Mozer et al. | 395/2.77 |
| 4,692,941 | 9/1987 | Jacks et al. | 395/2.69 |
| 5,109,418 | 4/1992 | Van Hemert | 395/2.22 |
| 5,327,498 | 7/1994 | Hamon | 395/2.77 |
| 5,490,234 | 2/1996 | Narayan | 395/2.69 |

FOREIGN PATENT DOCUMENTS

| | | | |
|---|---|---|---|
| 0 155 970 | 2/1985 | European Pat. Off. . | |
| WO 85/04747 | 10/1985 | WIPO . | |
| 90/03027 | 3/1990 | WIPO . | |
| WO 94/07238 | 3/1994 | WIPO . | |
| WO 96/27870 | 9/1996 | WIPO | G10L 5/04 |

OTHER PUBLICATIONS

Speech Communication 9(1990) pp. 453–457 Pitch Synchronous Waveform Processing Techniques . . . Dec. 1990.

T. Hirokawa, Segment Selection and Pitch Modification—pp. 337 to 340 (Japan) Nov. 1990.

K. Itoh, Phoneme Segment Concatenation and Excitation Control . . . —pp. 189–192 Nov. 1990.

E. Moulines et al; "Pitch–Synchronous Waveform Processing Techniques for Text–to–Speech Synthesis Using Diphones"; Speech Communication, vol. 9, No. 5/6, Dec. 1990, pp. 453–467.

*Primary Examiner*—David R. Hudspeth
*Assistant Examiner*—Donald L. Storm
*Attorney, Agent, or Firm*—Herbert Dubno

[57] ABSTRACT

A synthesis method in which that part of each interval of the original signal which contains the fundamental information is left unchanged, and only the remaining part of the interval is altered. In this way, not only is processing time reduced, but the natural sound of the synthetic signal is also improved. The main part of the interval is an exact reproduction of the original signal. At least the waveforms associated to voiced sounds are subdivided into a plurality of intervals, corresponding to the responses of the vocal duct to a series of excitation impulses of the vocal cords, synchronous with the fundamental frequency of the signal. Each interval is subjected to a weighting. The signals resulting from the weighting are replaced with a replica thereof shifted in time by an amount that depends on a prosodic information. The synthesis is then carried out by overlapping and adding the shifted signals. In each interval of original signal to be reproduced in synthesis, an unchanging part is identified, which contains the fundamental information and which is reproduced unaltered in the synthesized signal, and the operations of weighting, overlapping and adding involve only the remaining part of the interval. The search utilizes searching among all zero crossings for a suitable division between the unchanging and variable parts.

8 Claims, 17 Drawing Sheets

METHOD OF SPEECH SYNTHESIS BY MEANS OF CONCENTRATION AND PARTIAL OVERLAPPING OF WAVEFORMS

FIELD OF THE INVENTION

Our present invention relates to speech synthesis and more particularly to a synthesis method based on the concatenation of waveforms related to elementary speech units. Preferably, but not exclusively, the method is applied to text-to-speech synthesis.

BACKGROUND OF THE INVENTION

In these applications, a text to be transformed into a speech signal is first converted into a phonetic-prosodic representation, which indicates the sequence of corresponding phonemes and the prosodic characteristics (duration, intensity, and fundamental period) associated with them. This representation is then converted into a digital synthetic speech signal starting from a vocabulary of the elementary units, which in the most common case are constituted of diphones (voice elements extending from the stationary part of a phoneme to the stationary part of the subsequent phoneme, the transition between phonemes being included). For the Italian language, a vocabulary of about one thousand diphones ensures the phonetic coverage, allowing all admissible sounds for Italian language to be synthesized.

In systems for text-to-speech synthesis, methods based on the concatenation, in the time domain, of the waveforms representing the various elementary units can be used for the generation of the speech signal. These methods are very flexible and guarantee good synthetic speech quality.

An example is described by E. Moulines and F. Charpentier in the paper "Pitch-synchronous waveform processing techniques for text-to-speech synthesis using diphones", Speech Communication, Vol. 9, No. 5/6, Dec. 1990, pages 453–467. This method is based on the technique known as PSOLA (Pitch-Synchronous OverLap and Add), to apply the prosody imposed by the synthesis rules and concatenate the waveforms of the elementary units. At least for the voiced segments of the original signal, the PSOLA technique carries out an analysis by applying a pitch-synchronous windowing, in particular by using Hanning windows whose duration is roughly twice the fundamental period (pitch period), thereby generating a sequence of partially overlapping short-term signals. In the synthesis phase, the signals resulting from the windowing are shifted in time synchronously with the fundamental period imposed by the prosodic rules for synthesis. Finally, the synthetic signal is generated by overlapping and adding the shifted signals. To reduce computational complexity, the second step can be carried out directly in the time domain.

The complete windowing of the individual intervals of the original signal requires a relatively heavy computational load and moreover constitutes an alteration of the original signal extending over the entire interval, so that the synthetic signal sounds less natural.

SUMMARY OF THE INVENTION

According to the invention, a synthesis method is provided in which that part of each interval of the original signal which contains the fundamental information is left unchanged, and only the remaining part of the interval is altered. In this way, not only is processing time reduced, but the natural sound of the synthetic signal is also improved, since the main part of the interval is an exact reproduction of the original signal.

The invention therefore provides a method for the speech signal synthesis by means of time-concatenation of waveforms representing elementary speech signal units, in which: at least the waveforms associated with voiced sounds are divided into a plurality of intervals, corresponding to the responses of the vocal duct to a series of impulses exciting the vocal cords synchronously with the fundamental frequency of the signal; the waveform in each interval is weighted; the signals resulting from the weighting are replaced with a replica thereof, shifted in time by an amount depending on a prosodic information; and the synthesis is carried out by overlapping and adding the shifted signals;

and in which:

a current interval of an original signal to be reproduced in synthesis is subdivided into an unchanging part, which lies between the interval beginning and a left analysis edge represented by a zero crossing of the original speech signal that meets pre-determined conditions, and a changeable part, which lies between the left analysis edge and a right analysis edge essentially coinciding with the end of the current interval, the left and right analysis edges being associated, in the synthesized signal, respectively with a left and a right synthesis edge, of which the former coincides with the left analysis edge, with reference to a start-of-interval marker, and the latter coincides essentially with the end of the interval in the synthesized signal;

a first connecting function, which has a duration equal to that of the segment of synthesized waveform lying between the left and right synthesis edges and an amplitude which decreases progressively and has a maximum in correspondence with the left analysis edge, is applied on the part of waveform on the right of the left analysis edge of the current interval of original signal;

a second connecting function, which has a duration equal to that of the segment of synthesized waveform lying between the left and right synthesis edges and an amplitude which increases progressively and is maximum in correspondence with the beginning of said subsequent interval, is applied on the part of waveform on the left of the subsequent interval of original signal to be reproduced synthetically; and each interval of synthesized signal is built by reproducing unchanged the waveform in the unchanging part of the original interval by joining thereto the waveform obtained by aligning in time and adding the two waveforms resulting from the application of the first and second connecting functions.

BRIEF DESCRIPTION OF THE DRAWING

The above and other objects, features, and advantages will become more readily apparent from the following description, reference being made to the accompanying drawing in which.

SPECIFIC DESCRIPTION

Before describing the invention in detail, the structure of a text-to-speech synthesis system is briefly described.

Figure 1:
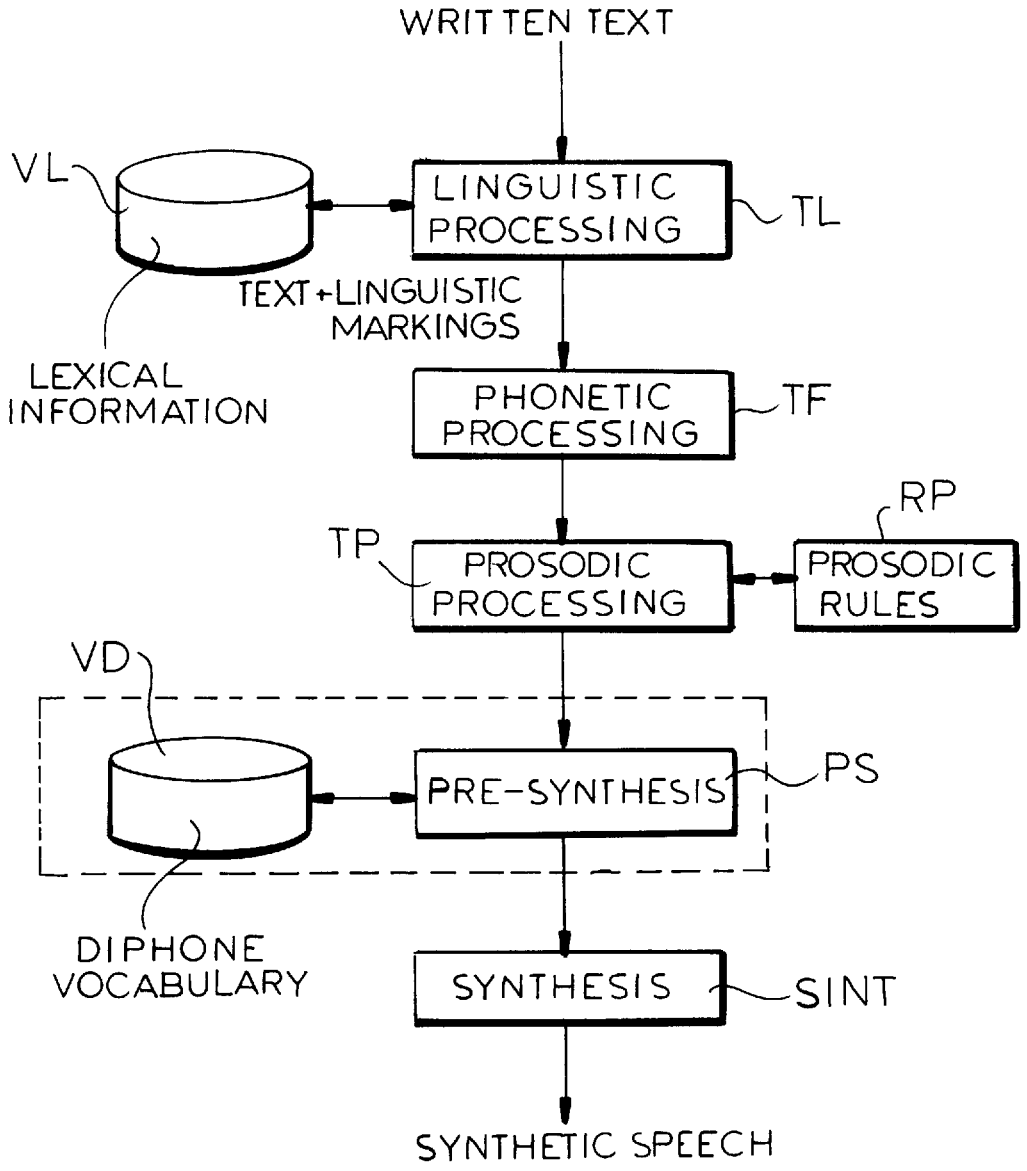
FIG. 1 is a general outline of the operations of a text-to-speech synthesis system through concatenation of elementary acoustic units.

As can be seen in FIG. 1, as a first phase the written text is fed to a linguistic processing stage TL which transforms the written text into a pronounceable form and adds linguistic markings: transcription of abbreviations, numbers, . . . , application of stress and grammatical classification rules, access to lexical information contained in a special vocabulary VL. The subsequent stage, TF, carries out the transcription from an orthographic sequence to the corresponding string of phonetic symbols. On the basis of a set of prosodic rules RP, the prosodic processing stage TP provides duration and fundamental period (and thus also fundamental frequency) for each of the phonemes leaving the transcription stage TF. This information is then provided to the pre-synthesis stage PS, which determines for each phoneme, the sequence of acoustic signals forming the phoneme (access to diphone data base VD) and, for each segment, how many and which intervals, with duration equal to the fundamental period, are to be used (in the case of voiced sounds) and the corresponding values of the fundamental period to be attributed in synthesis. These values are obtained by interpolating the values assigned in correspondence with the phoneme borders. In the case of unvoiced or "surd" sounds, in which there are no periodicity characteristics, the intervals have a fixed duration. This information is finally used by the actual synthesizer SINT which performs the transformations required to generate the synthetic signal.

Figure 2:
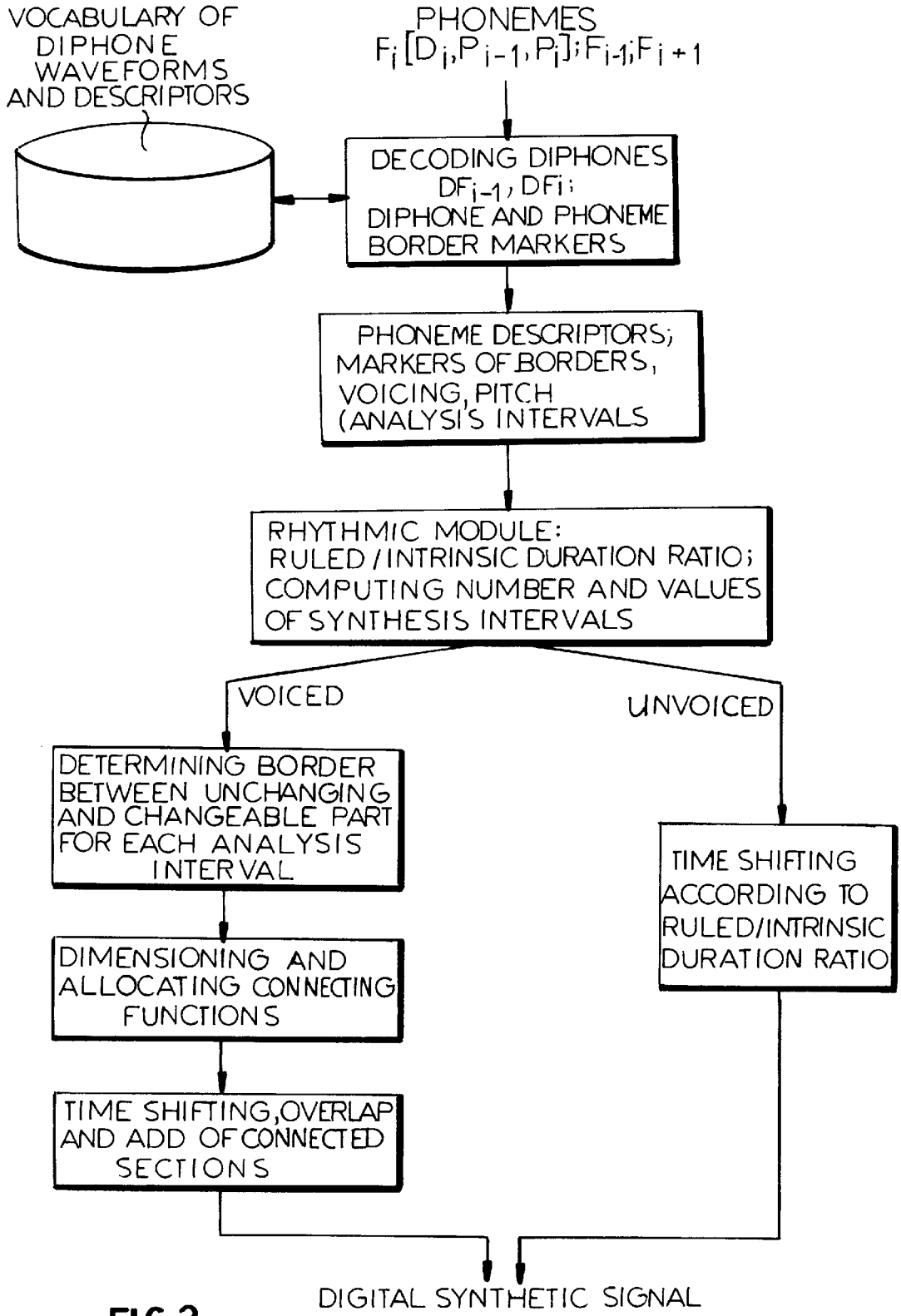
FIG. 2 is a diagram of the synthesis method through concatenation of diphones and modification of the prosodic parameters in the time domain, according to the invention.

FIG. 2 illustrates in greater detail the operation of modules PS and SINT. The input is constituted by the current phoneme identifier $F_i$, by the phoneme duration $D_i$ and by the values of the fundamental period $P_{i-1}$ at the beginning of the phoneme and $P_i$ at the end of the phoneme, and by the identifiers of the previous phoneme $F_{i-1}$ and of the subsequent phoneme one $F_{i+1}$. The first operation to be performed is to decode diphones $DF_{i-1}$ and $DF_i$ and to detect the markers of diphone beginning and end and of phoneme border. This information is drawn directly from the data base or vocabulary storing diphones as waveforms and the related border, voiced/unvoiced decision and pitch marking descriptors. The subsequent module transforms said descriptors taking the phoneme as a reference. On the basis of this information, a rhythmic module computes the ratio between duration $D_i$ imposed by the rule and the intrinsic duration of the phoneme (memorized in the vocabulary and given by the sum of the two portions of the phoneme belonging to the two diphones $DF_{i-1}$ and $DF_i$). Then, taking into account the modification of the duration, the rhythmic module computes the number of intervals to be used in synthesis and determines the value of the fundamental period for each of them, by means of an interpolation law between values $P_{i-1}$ and $P_i$. The value of the fundamental period is then actually used only for voiced sounds, while for unvoiced sounds, as stated above, intervals are considered to be of fixed duration.

For the actual synthesis, the operations are different depending on whether the sound is voiced or unvoiced.

In the case of unvoiced sound, the synthesis demands a simple time shift (lengthening or shortening) of the aforesaid intervals on the basis of the ratio between the duration imposed by the prosodic rules and the intrinsic duration. In the case of voiced sound, instead, the method according to the invention is applied.

The synthesis method according to the invention starts from the consideration that a voiced sound can be considered as a sequence of quasi-periodic intervals, each defined by a value $p_a$ of the fundamental period. This is clearly seen in FIG. 3, which shows the waveform of diphone "a_m", the related markers separating individual intervals and, for each interval, value $p_a$ of the corresponding period expressed in Hz. The part of FIG. 3 between the two markers "v" corresponds to the right portion of phoneme "a"; the part between the second marker "v" and the end-of-diphone marker "f" corresponds to the left part of phoneme "m". The aforesaid intervals may be considered as the impulse responses of a filter, stationary for some milliseconds and corresponding to the vocal duct, which is excited by a sequence of impulses synchronous with the fundamental frequency of the source (vibrating frequency of the vocal cords). For each interval the synthesis module is to receive the original signal with fundamental period $p_a$ (analysis period) and to provide a signal modified with period $p_s$ (synthesis period) required by prosodic rules.

The essential information characterizing each speech interval is contained in the signal part immediately following the excitation impulse (main part of the response), while the response itself becomes less and less significant as the distance from the impulse position increases. Taking this into account, in the synthesis method according to the invention this main part is maintained as unchanged as is possible and the lengthening or shortening of the period required by the prosodic rules are obtained by acting on the remaining part.

For this purpose, an unchanging and a changeable part are then identified in each interval, and only the latter is involved in connection, overlap and add operations. The unchanging part of the original signal is not constant, but rather it depends for each interval on the ratio between $p_s$ and $p_a$. This unchanging part lies between the start-of-interval marker and a so-called left analysis edge $b_{sa}$, which is one of the zero crossings of the original speech signal, identified with criteria that will be described further on and that can be different depending on whether the synthesis period is longer, shorter or equal to the analysis period. The changeable part is delimited by the left analysis edge $b_{sa}$ and by a so-called right analysis edge $b_{da}$, which essentially coincides with the end of the interval, in particular with the sample preceding the start-of-interval marker of the subsequent interval.

In the synthesized signal, a left and a right synthesis edge $b_{ss}$, $b_{ds}$ will correspond to the left and right analysis edge $b_{sa}$, $b_{da}$. For a given interval, the left synthesis edge obviously coincide with the left analysis edge, with reference to the start-of-interval marker, since the preceding part of signal is reproduced unaltered in the synthesis. The right synthesis edge is defined by relation $$b_{ds}=b_{ss}+\Delta p \tag{1}$$

where $\Delta p=p_s-p_a$ will have a positive or negative value depending on whether, in synthesis, there is a lengthening or shortening of the fundamental period.

The changeable part of the interval is modified by applying a pair of connecting functions whose duration is $\Delta s=b_{ds}-b_{ss}$. The first function has a maximum value (specifically 1) in correspondence with the left analysis, edge and a minimum value (specifically 0) in correspondence with the point $b_{sa}+\Delta s$. The second function has a maximum value (specifically 1) in correspondence with the right analysis edge $b_{da}$ and a minimum value (specifically 0) in correspondence with point $b_{da}-As$. The connecting functions can be of the kind commonly used for these purposes (e.g. Hanning windows or similar functions).

Figure 4:
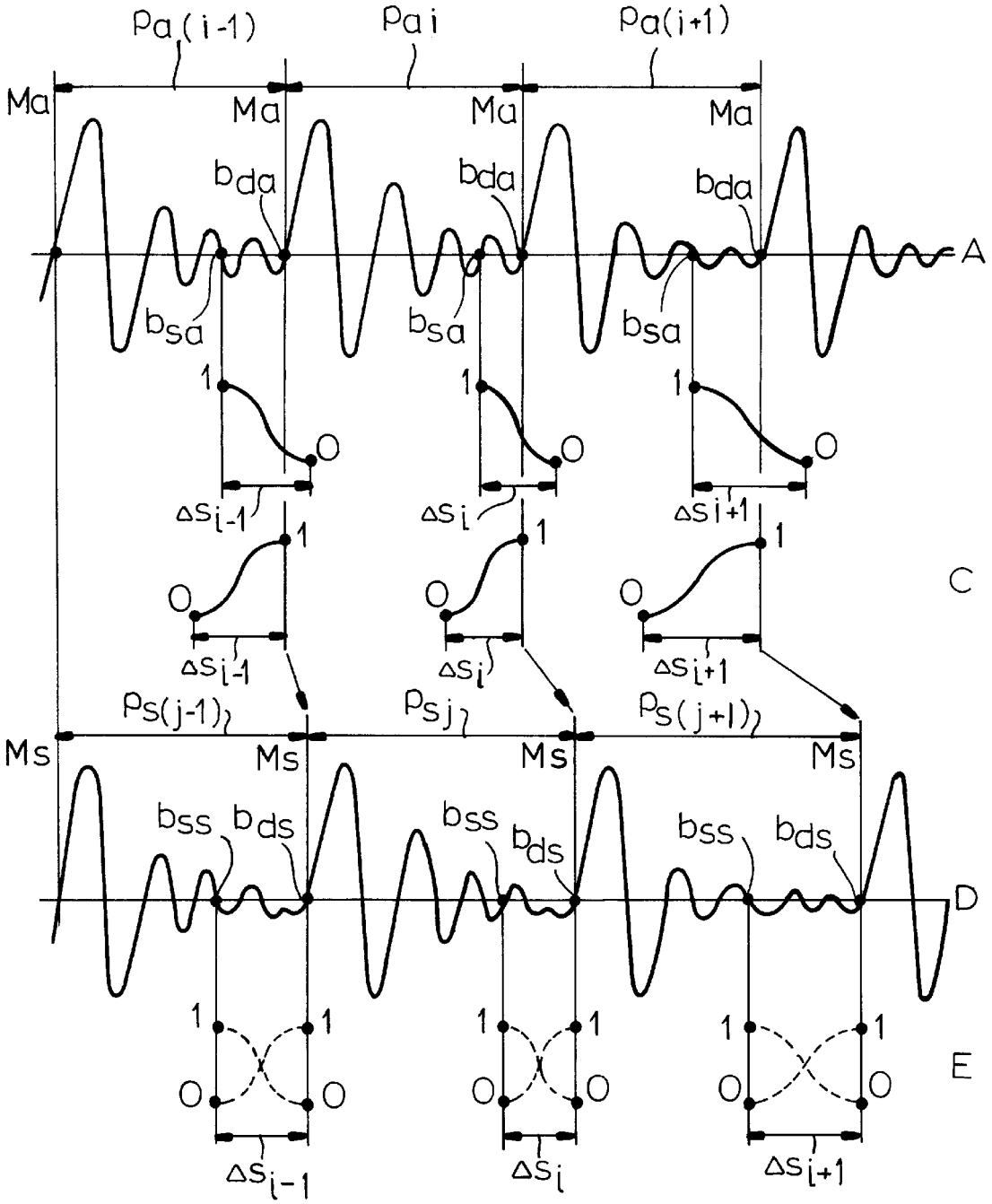
FIGS. 4, 5 and 6 are graphs representing how the prosodic parameters of a natural speech signal are modified in some particular cases, according to the invention.
Figure 5:
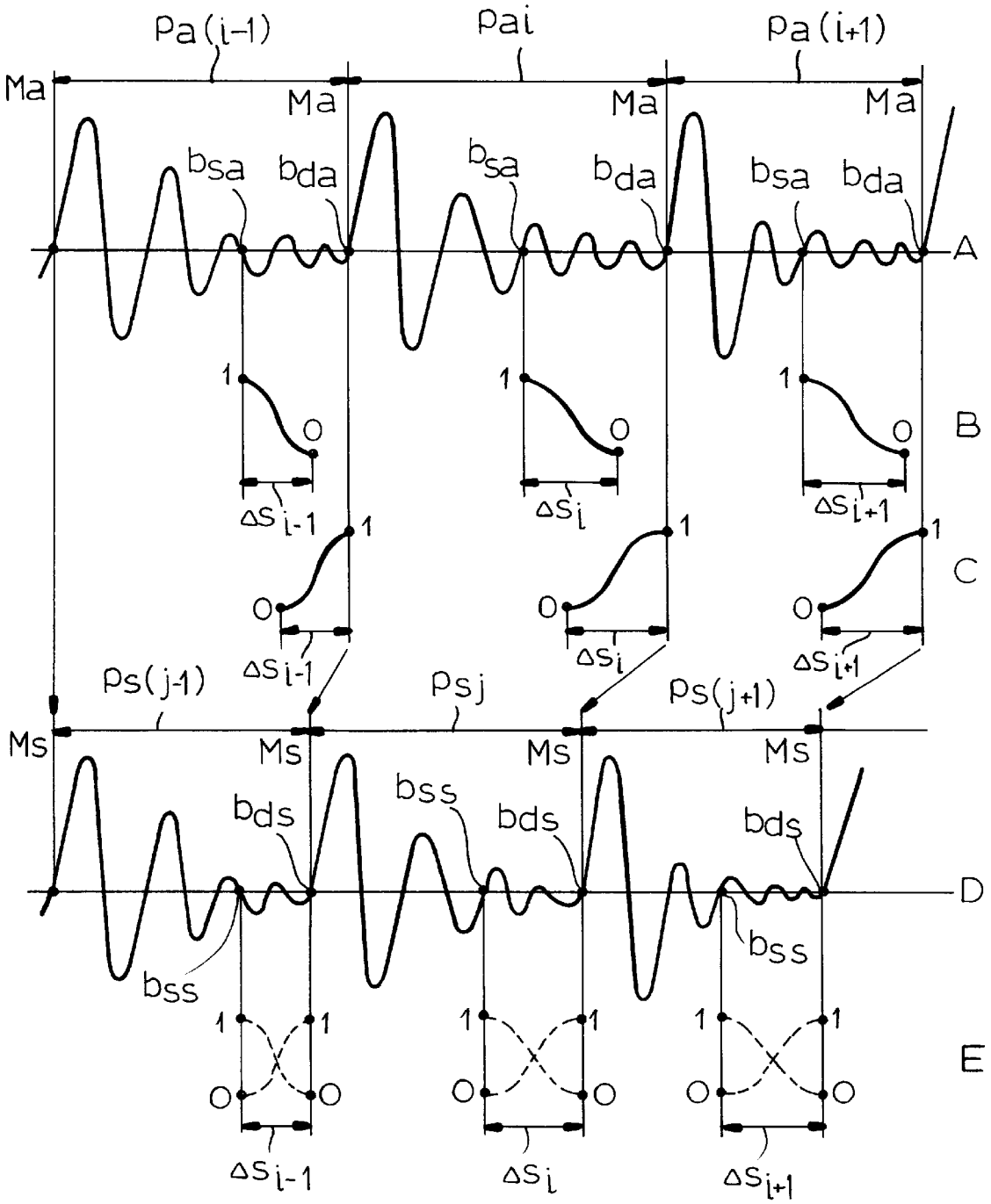
Figure 6:
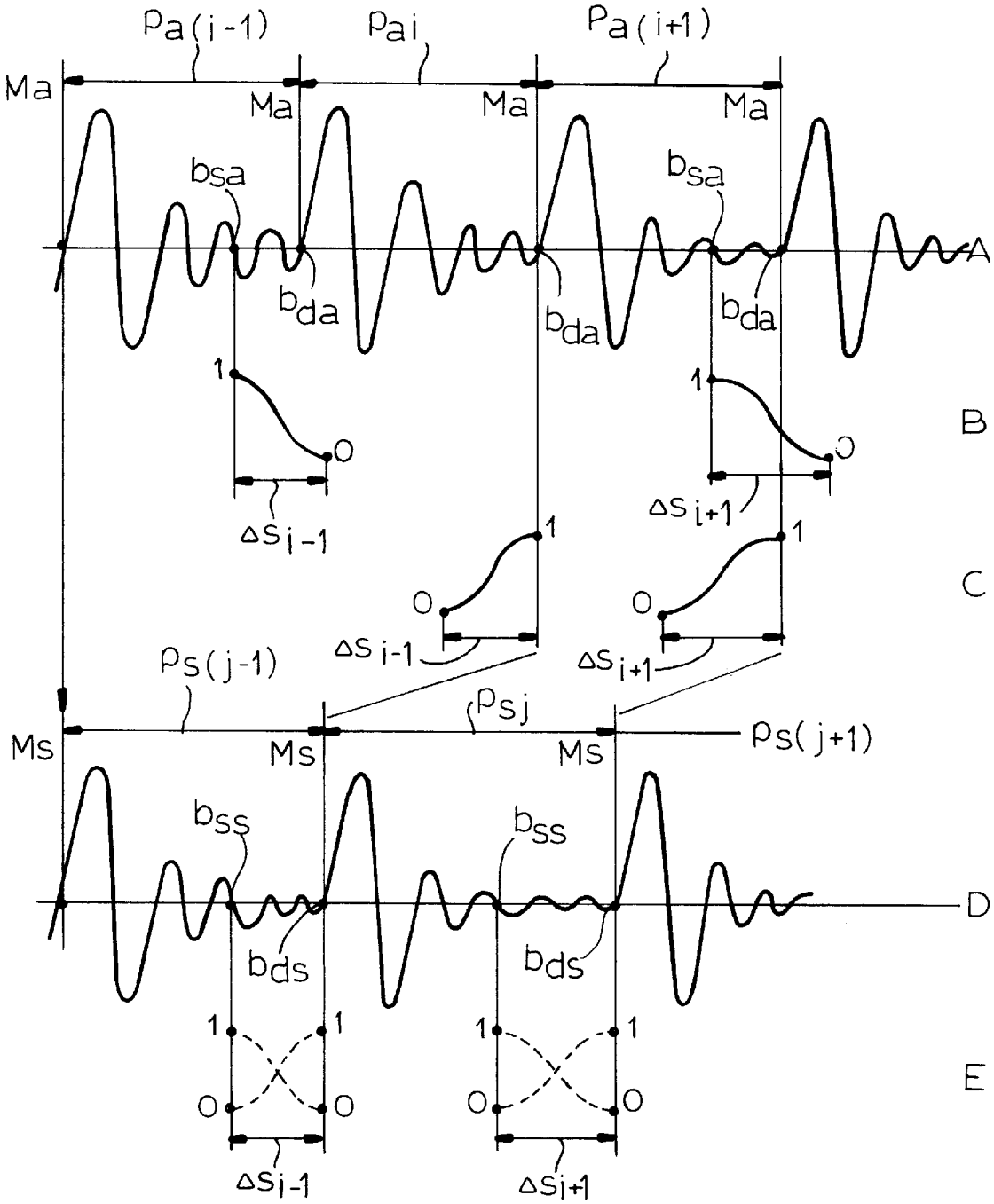

For the sake of further clarifying the invention, FIGS. 4–6 show some graphs illustrating the application of the method to a fictitious signal. In these Figures, part A shows three consecutive intervals of the original signal, with indexes i−1, i, i+1, and indicates also their fundamental periods $p_{ah}$ (h=i−1, i, i+1) as well as pitch (or start-of-interval) markers Ma and the left and right analysis edges $b_{sa}$, $b_{da}$. Parts B and C show, for each interval, respectively the first and second connecting functions (which hereinafter shall be called for the sake of simplicity "function B" and "function C") and the time relations with the original signal. Part D shows the synthesized signal waveforms resulting from the method according to the invention, with the indication of the respective fundamental periods $p_{sk}$ (k=j−1, j, j+1), of pitch markers Ms and of left and right synthesis edges $b_{ss}$, $b_{ds}$. Part E is a representation of the waveform portion where, after the time shift, the waveforms obtained with the application of the two connecting functions to the changeable part of the original signal are submitted to the overlapping and adding process. Note that the serial numbers of the intervals in analysis and synthesis can be different, since suppressions or duplications of intervals may have occurred previously.

In particular, FIG. 4 illustrates the case of an increase in fundamental period (and therefore decrease in frequency) in synthesis with respect to the original signal, in a signal portion where no interval suppressions or duplications have occurred. Weighting is carried out in each interval with a respective pair of connecting functions. As a consequence of the period increase, duration Δs of the functions is greater than the length of the variable part of the original signal, so that function B represents the beginning of the waveform related to the subsequent interval, while function C interests a part of waveform on the left of the left analysis edge.

FIG. 5 shows an analogous representation in the case of decrease in fundamental period (and therefore increase in frequency) in synthesis with respect to the original signal. In this example too no interval suppressions or duplications occurred. In this case functions B, C represent a waveform portion with shorter duration than the portion lying between $b_{sa}$ and $b_{da}$.

Finally, FIG. 6 shows an example of increase in fundamental period in synthesis in the case of suppression of an interval of the original signal (the one with index i in the example). Two intervals are obtained in synthesis, indicated by indexes j−1 and j, which intervals respectively maintain, as unchanging part, the one of intervals with index i−1 and i+1 in the original signal. The interval with index i+l in the original signal is processed in the same way as each interval of the original signal in FIG. 4. The modified part of the interval with index j−1 in the synthesized signal, instead, is obtained by overlapping and adding the two waveforms obtained by weighting only with function B the changeable part of the interval with index i−1 in the original signal, and by weighting only with function C the final part of the interval with index i in the original signal. In other words, function B is applied on the right of $b_{sa}$ in the current interval to be reproduced in synthesis, and function C is applied on the left of the subsequent interval to be reproduced. These procedures of application of the connecting functions are quite general and are applied also in case of interval duplication and diphone change.

Purely by way of example, for the diagrams in FIGS. 4–6 the following functions were utilized:

$$0.5-0,5\cdot\cos\{\pi[(\Delta s-1+b_{ss}-x_i)/(\Delta s-1)]^n\} \quad \text{(function B)}$$

$$0,5-0,5\cdot\cos\{\pi[(x_i-b_{ss})/(\Delta s-1)]^n\} \quad \text{(function C)}$$

In these functions, $b_{ss}$, Δs have the meaning seen previously and are expressed as a number of samples; $x_i$ is the generic sample of the variable part of the original waveform (with $b_{sa}\leqq x_i<b_{sa}+\Delta s$, for function B, and $b_{da}-\Delta s\leqq x_i<b_{da}$ for function C); n is a number which can vary (e.g. from 1 to 3) depending on ratio $\Delta s/p_a$. In particular, in the drawing, n was considered to be 1. Obviously, in the formulas, value 0.5 can be replaced by a generic value A/2 if a function whose maximum is A instead of 1 is used, or by a pair of values whose sum is 1 (or A).

Figure 3:
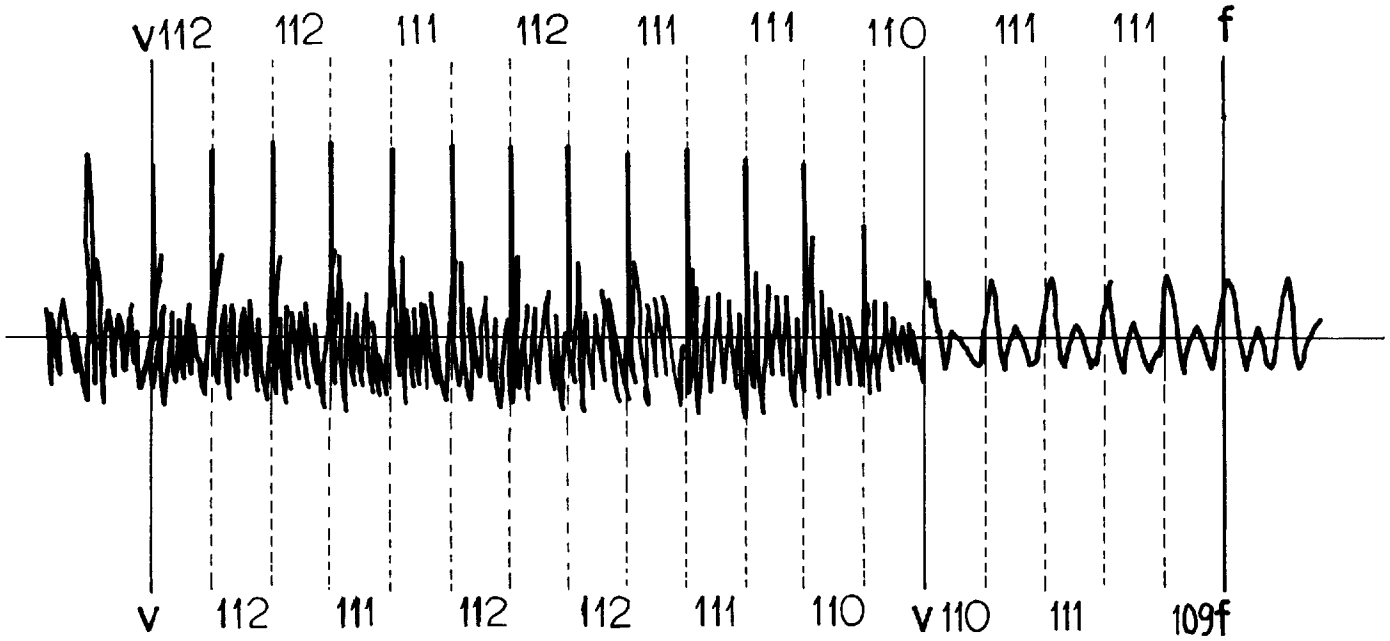
FIG. 3 is a diagram of the waveform of a real diphone, with the markers for the phonetic and diphone borders and the pitch markers.
Figure 7A:
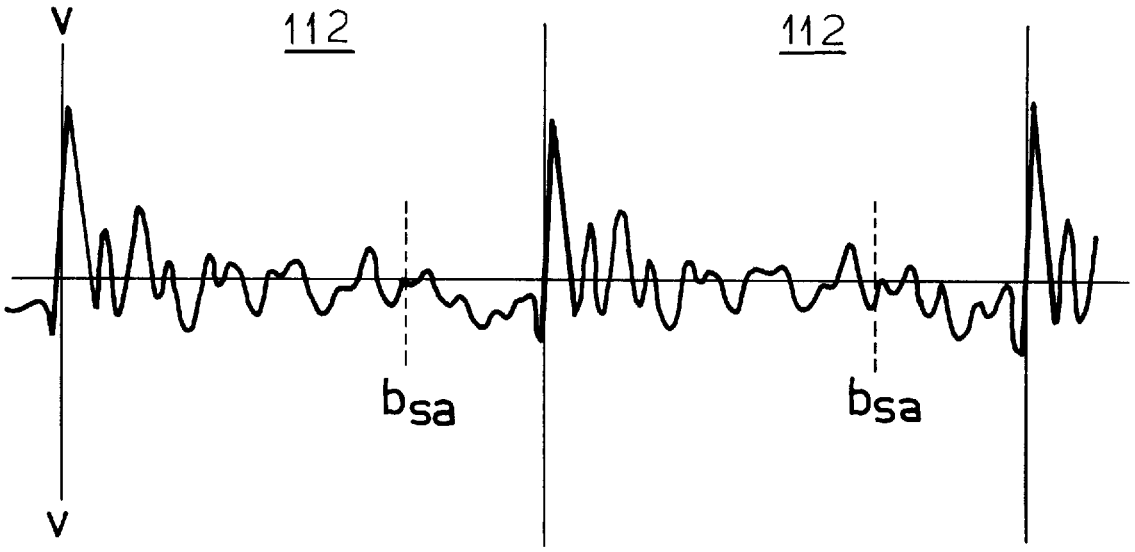
FIGS. 7A, 7B, 8A, 8B, 9A, 9B, 10A and 10B are graphs of some real examples of application of the method according to the invention for the modification of the fundamental period on segments of the diphone in FIG. 3.
Figure 7B:
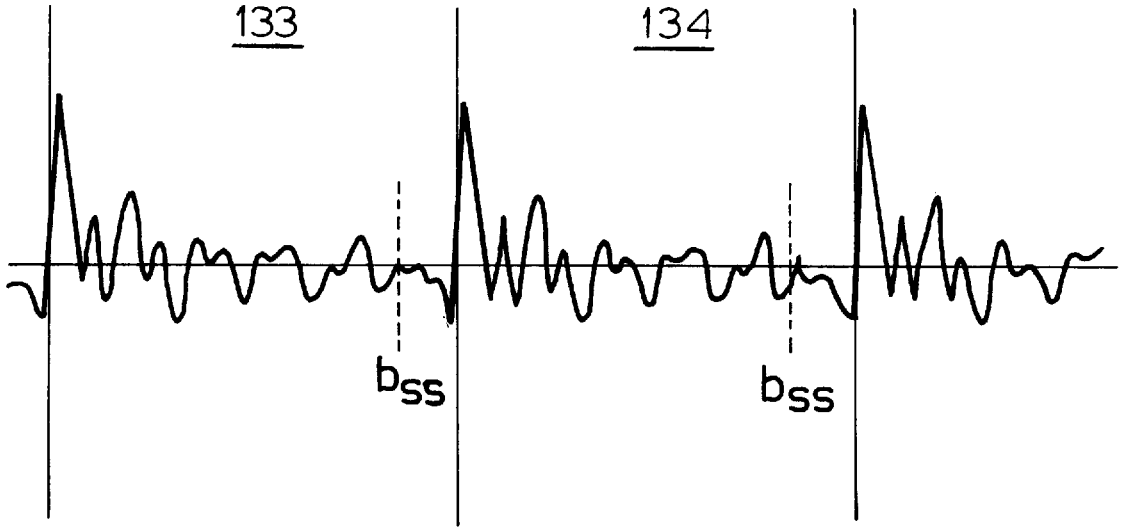
Figure 8A:
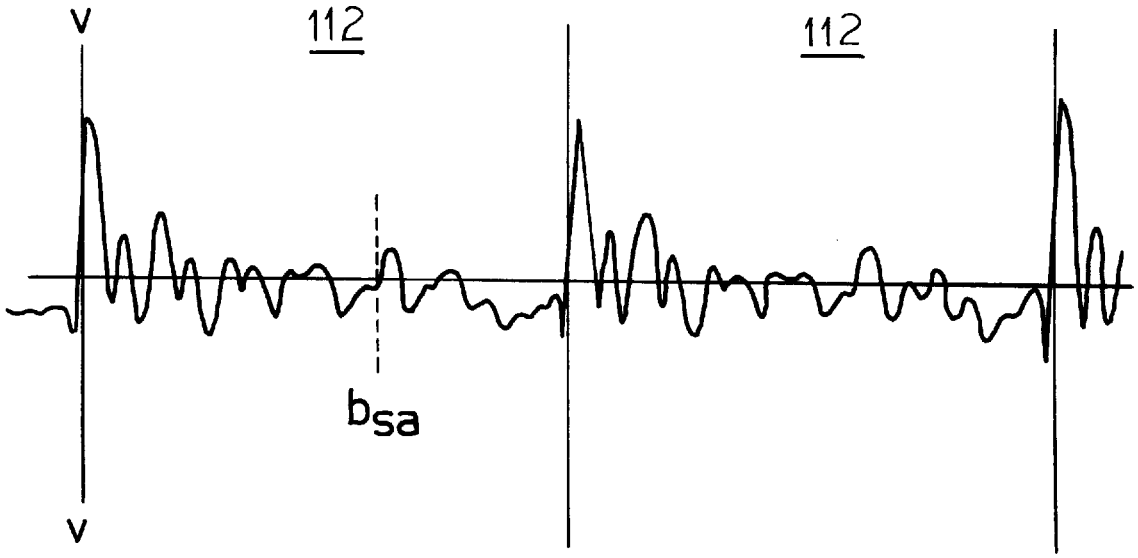
Figure 8B:
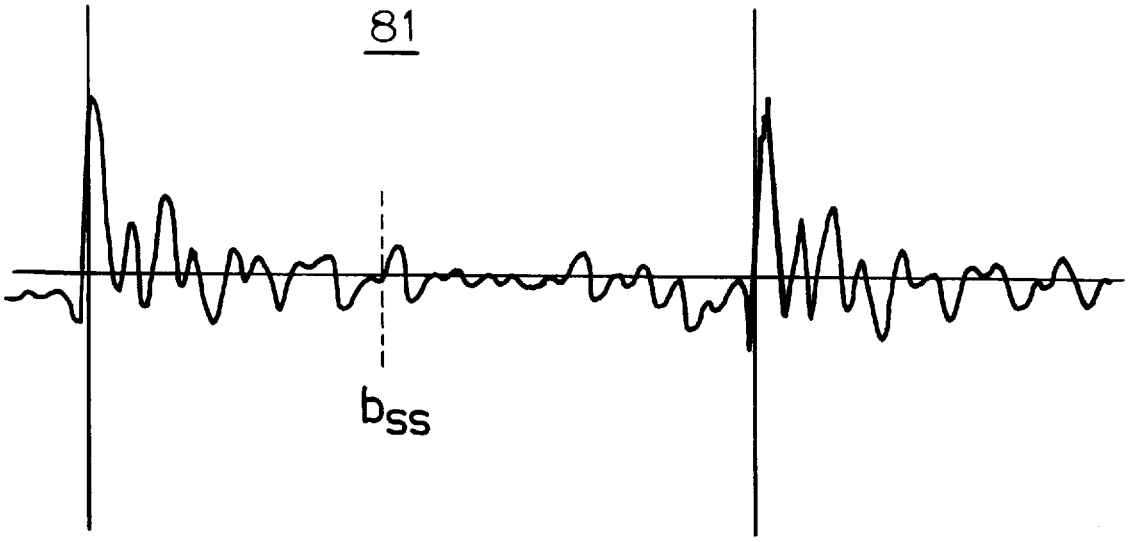
Figure 9A:
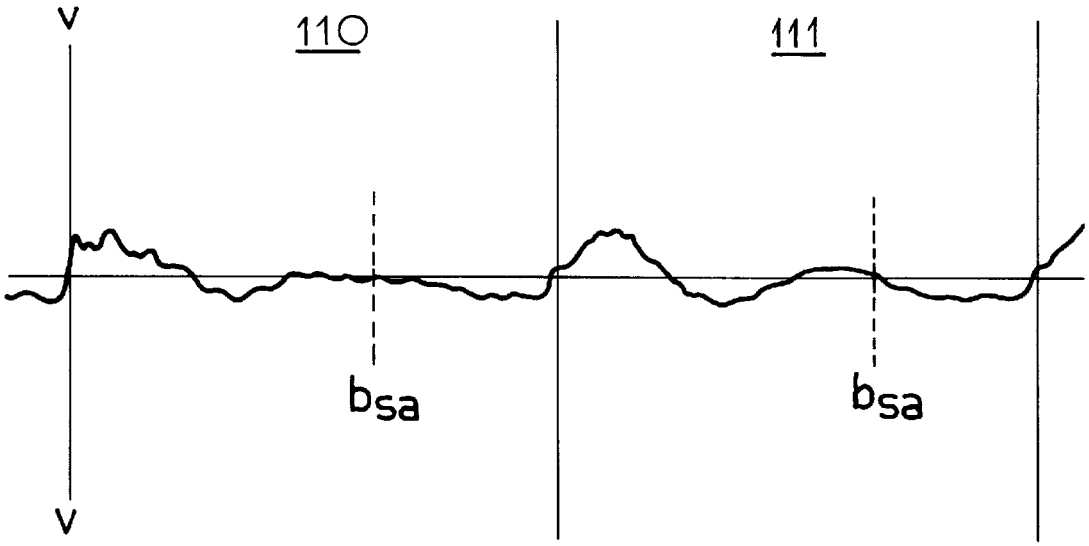
Figure 9B:
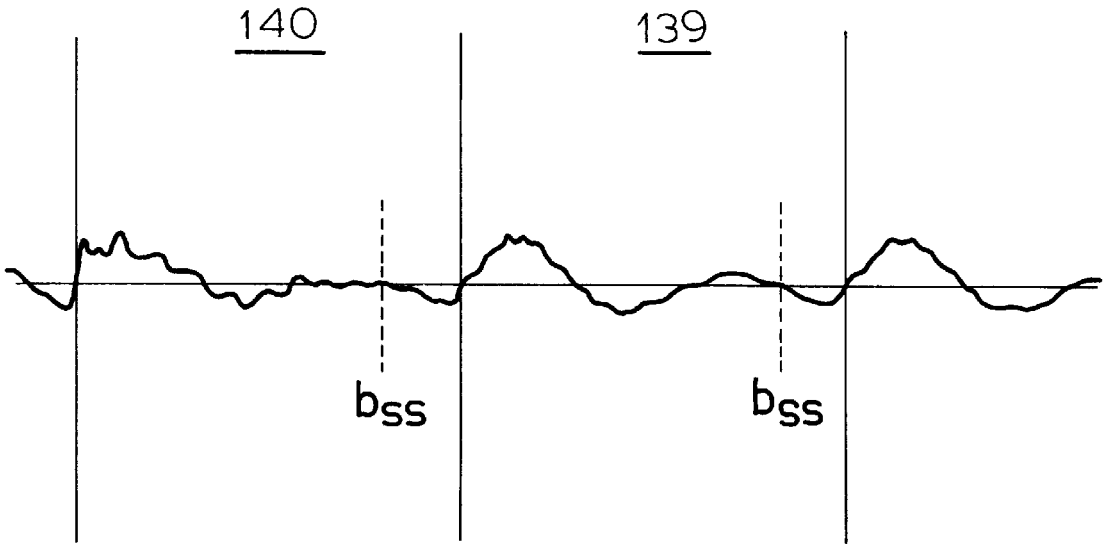
Figure 10A:
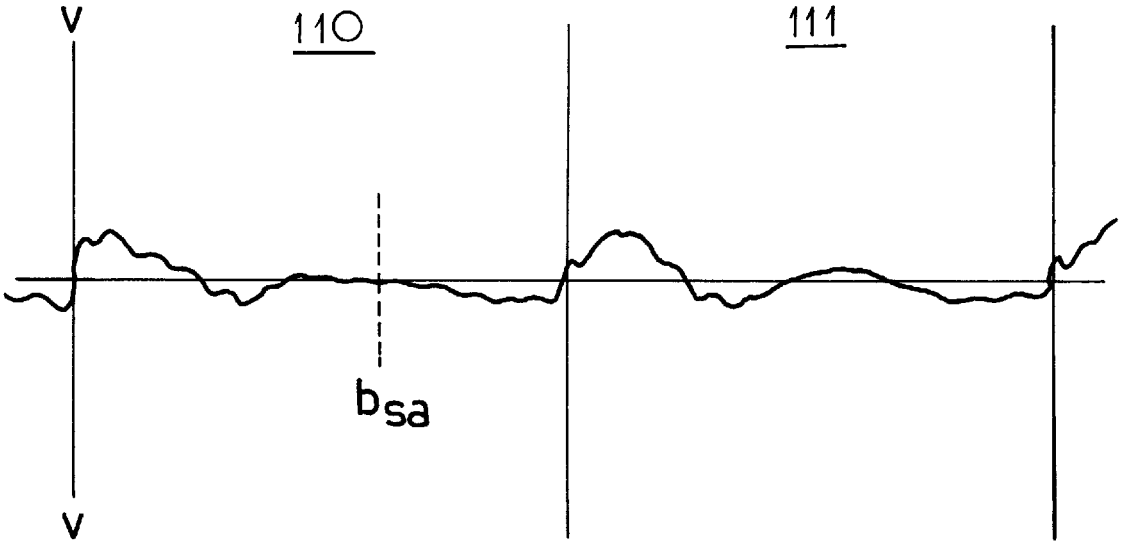
Figure 10B:
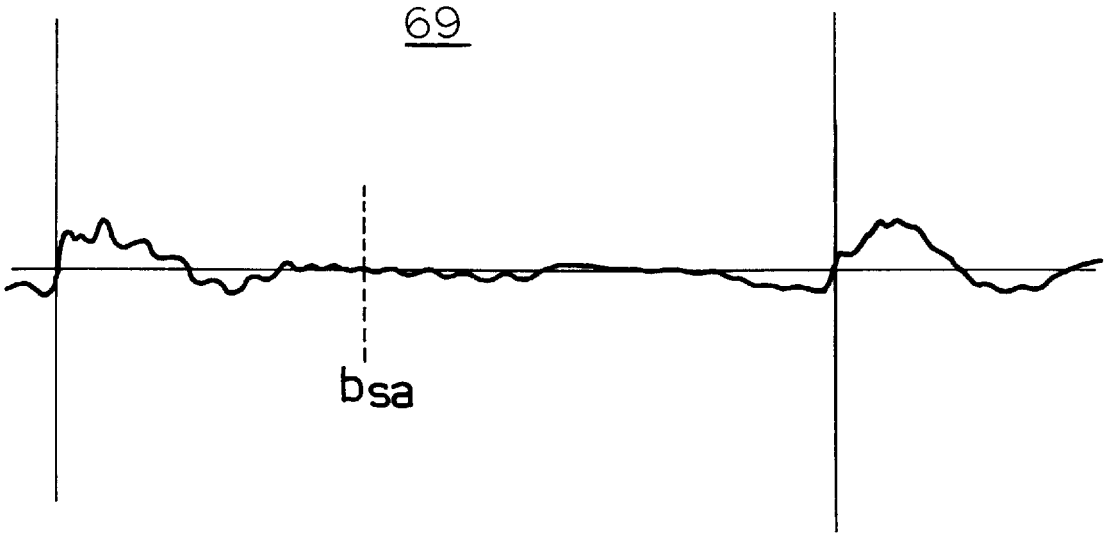

FIGS. 7A, 7B to 10A, 10B represent some real examples of application of the method, for two portions of the diphone "a_m" of FIG. 3, utilized in two different positions in the sentence where the synthesis rules require respectively a decrease and an increase in fundamental period (and therefore an increase and respectively a decrease in fundamental frequency). For all intervals, pitch markers, left analysis and synthesis edges and fundamental frequency, both in analysis and synthesis, are indicated. Figures with letter A show the original waveform and Figures with letter B the synthesized signal. FIGS. 7A, 7B, 8A, 8B show the first two intervals of the diphone being examined (phoneme "a") in case of increase (FIGS. 7A, 7B) and respectively of decrease (FIGS. 8A, 8B) of the fundamental frequency. FIGS. 9A, 9B, 10A, 10B show instead the first two intervals of phoneme "m" in the same conditions as illustrated in FIGS. 7, 8. As an effect of the frequency decrease, only the first interval is completely visible in FIGS. 8B and 10B.

A preferred embodiment of the method adopted to identify the left analysis and synthesis edge for each interval to be reproduced in synthesis will now be described. In the example described, a different method is used depending on whether the fundamental period in synthesis is smaller than or equal to the period in analysis, or it is greater.

Figure 11:
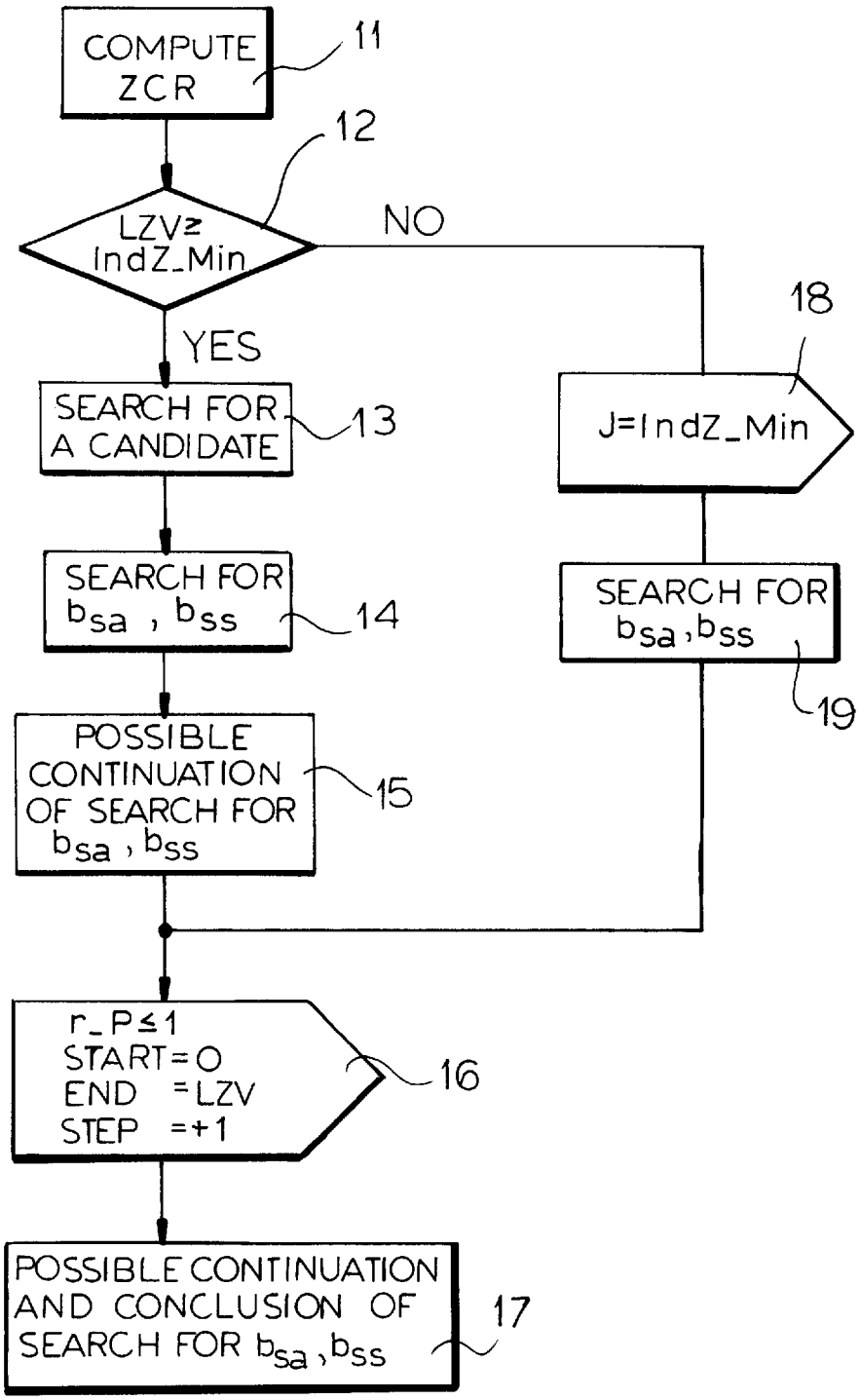
FIGS. 11–18 are flow charts of the operations for determining the left analysis and synthesis edge.

FIG. 11 is the general flow chart of the operations carried out if $p_s\leqq p_a$.

The first operation is the computation of function ZCR (Zero Crossing Rate) indicating the number of zero crossings (step 11). In this computation, zero crossings that are spaced apart from the previous one by less than a limited number of signal samples (e.g. 10) are neglected, in order to eliminate non-significant oscillations of the signal.

Figure 13:
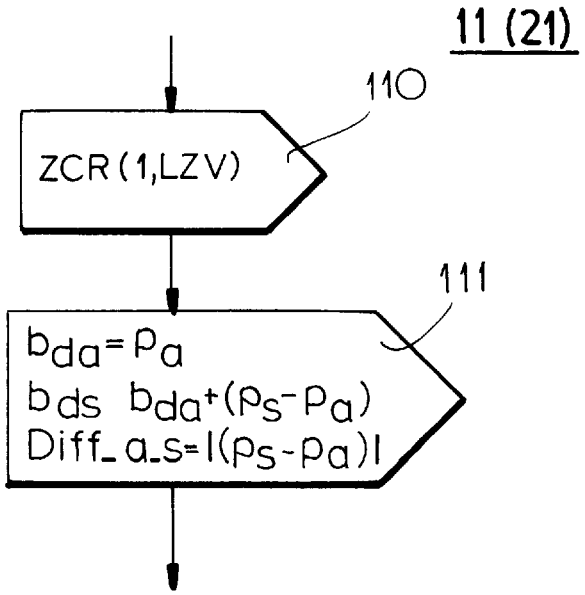

As can be seen in FIG. 13, the zero crossings that are considered are assigned an index varying from 1 to the descriptor of the total zero crossing number LZV (step 110). Moreover, the following variables are assigned (step 111):

$b_{da}$ (right analysis edge) to the value of the analysis period $p_a$;

$b_{ds}$ (right synthesis edge) to the value of the synthesis period $b_{da}+\Delta p$;

Diff_a_s to the absolute value $|\Delta p|$ of the difference between the analysis and synthesis periods.

In these relations, as in those examined further on, the values of the period and the lengths of certain intervals are expressed in terms of number of samples.

Going back to FIG. 11, after computing function ZCR, a check is made (step 12) that the number of zero crossings found in step 11 is not lower than a minimal threshold of zero crossings IndZ_Min (e.g. 5 crossings). Actually, according to the invention, it is desired to reproduce unaltered, in the synthesized signal, the oscillations immediately following the excitation impulse, which oscillations, as stated, are the most significant ones. If the check yields a positive result, a possible candidate is searched among the zero crossings that were found (step 13) and subsequently a first phase of search for the left synthesis and analysis edges $b_{ss}$, $b_{sa}$ is carried out (step 14). If at the end of step 14 no suitable zero crossing has been found, a search continuation phase is started (step 15) and, if after this phase the left synthesis and analysis edges have not yet been identified, then a phase of continuation and conclusion of the search is started (step 17). If the comparison in step 12 indicates that the number of zero crossings is lower than the threshold, then the zero crossing with index J=IndZ_Min is arbitrarily considered as a candidate (step 18) and a search for $b_{sa}$ and $b_{ss}$ (step 19), identical to the one carried out in step 14, is performed: if this search is unsuccessful, then step 17, i.e. the search continuation and conclusion, is directly started, without going through step 15, for reasons that will be clear after the latter is described.

A step analogous to step 17 is envisaged also in case of lengthening of the fundamental period in synthesis, as will be seen further on. For the sake of simplicity, the same flow chart was used for both cases, which are distinguished by means of some conditions of entry into the step itself. In particular, for the case $p_s \leqq p_a$ the conditions r_P≦1 (where r_P is the ratio $p_s/p_a$), Start=0, End=LZV, Step=+1 (step 16 in FIG. 11) are set. The first condition is evident. The other three indicate that the cycle of examination of the zero crossings envisaged in phase 17 is carried out in the order of increasing indexes.

The operations performed in steps 13–15 and 17 will be described in detail further on, with reference to FIGS. 14–17.

Figure 12:
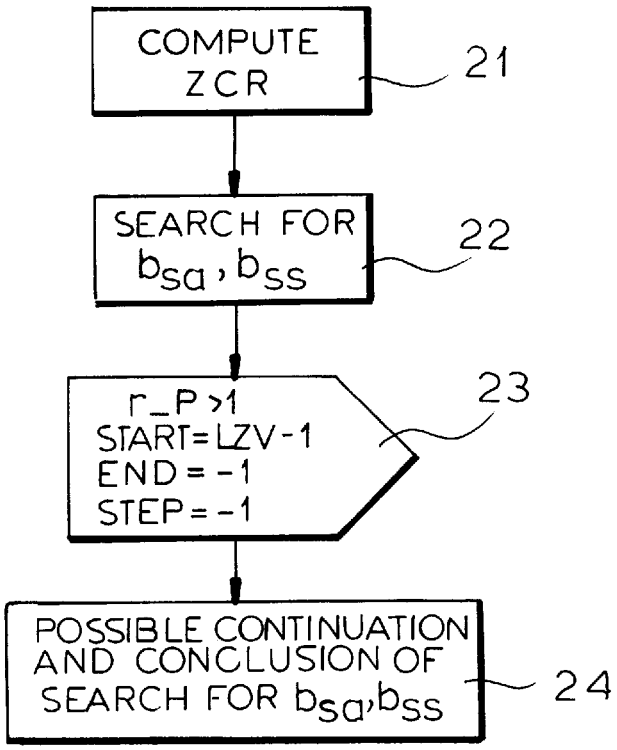

FIG. 12 is the general flow chart of the operations carried out if the synthesis period $p_s$ is longer than the analysis period $p_a$. The first operation (step 21) consists again in computing function ZCR and is identical to step 11 in FIG. 11. Subsequently (step 22) a search is carried out for the left synthesis and analysis edges, with procedures that will be described with reference to FIG. 18, and, if this phase does not have a positive outcome, a search continuation and conclusion phase is initiated (step 24), corresponding to step 17 in FIG. 11. Conditions r_P>1, Start=LZV−1, End=−1, Step=−1 are set for the operations envisaged in step 24. The first condition is evident. The other three indicate that the cycle of examination of the zero crossings envisaged in step 24 will be carried out in this case in the order of decreasing indexes.

Figure 14:
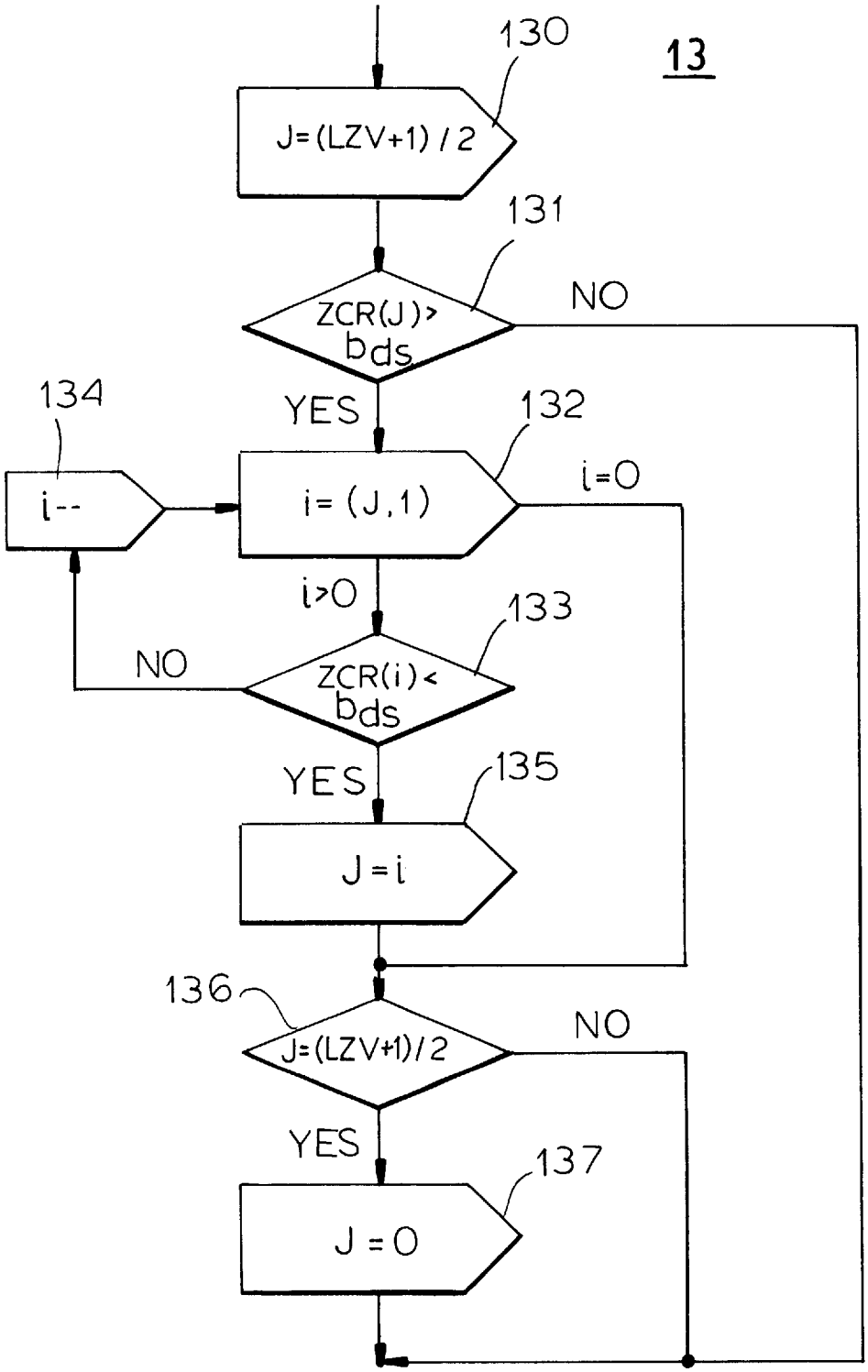

FIG. 14 is a flow chart of the search for a zero crossing which is candidate to act as left analysis and synthesis edge (step 13 in FIG. 11). J denotes the index of the candidate. In particular, the central zero crossing, whose index is J=(LZV+1)/2 (step 130), is initially examined as a candidate and its abscissa ZCR(J) is compared with the right synthesis edge $b_{ds}$ (step 131). If this initial candidate is already on the left of the right synthesis edge, the phase of search for the left analysis and synthesis edge (step 14, FIG. 11) is started directly. In the opposite case, zero crossings on the left of the central one are examined with a backwards cycle, searching for a candidate whose abscissa is on the left of $b_{ds}$ (steps 132–134). When a zero crossing that meets this condition is found, it is considered as a candidate (step 135) and the search phase (step 14 in FIG. 1) is started after verifying that the index of the candidate is not (LZV+1)/2 (step 136). In effect, a backward search cycle has been performed because the initial candidate, with index (LZV+1)/2, was on the right of $b_{ds}$, and hence obtaining a candidate with that index signals an anomalous condition. If this occurs, the search phase is started after setting J=0. The same operations are performed if the cycle ends before a candidate is found.

Figure 15:
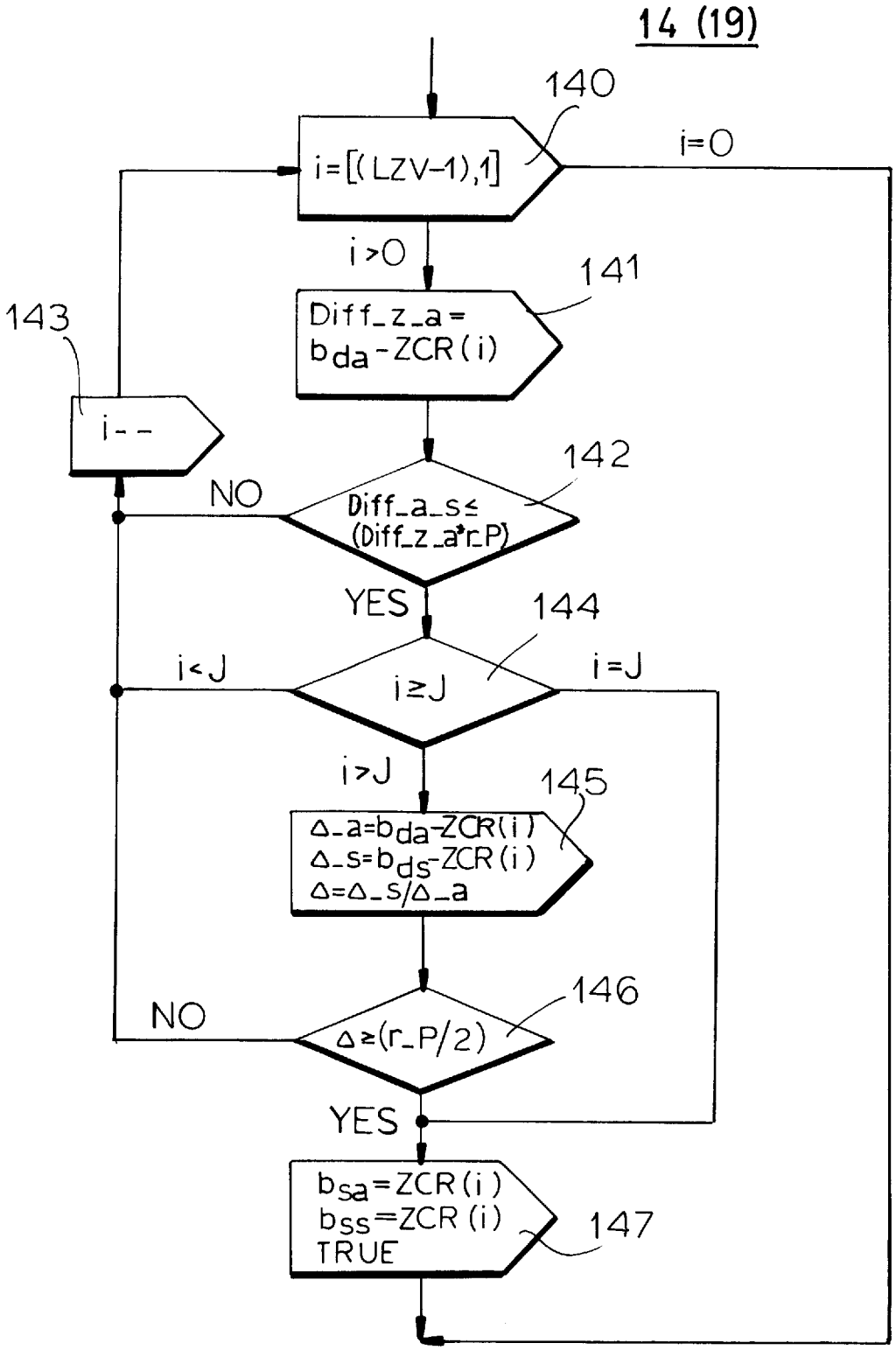

FIG. 15 shows the operations carried out for the first phase of search for $b_{ss}$, $b_{sa}$ (step 14 in FIG. 11). For this search, a backward examination is made of the zero crossings starting from the one preceding LZV, and the distance Diff_z_a between the right analysis edge $b_{da}$ and the current zero crossing ZCR(i) is calculated (steps 140, 141). This distance, multiplied by r_P (ratio between the synthesis period $p_s$ and the analysis period $p_a$) is compared with Diff_a_s (step 142), to check that there is a time interval sufficient to apply the connecting function. Weighting with r_P links the duration of that function to the percentage shortening of the period and it is aimed at guaranteeing a good connection between subsequent intervals. If Diff_a_s>Diff_z_a*r_P, the search cycle continues (step 143), until a zero crossing is found such that Diff_a_s<(Diff_z_a*r_P) or until all zero crossings have been considered: in the latter case step 14 is left and step 15 (FIG. 11) of search continuation, is started. When the condition Diff_a_s<Diff_z_a*r_P is met, the current index i is compared with index J of the candidate (step 144). If i<J, the cycle is continued. If the two indexes are equal, then the current zero crossing is considered as left analysis edge $b_{sa}$ and as left synthesis edge $b_{ss}$ (step 147); if instead i>J, then distance A_a between the right analysis edge $b_{da}$ and the current zero crossing ZCR(i), distance A_s between the right synthesis edge $b_{ds}$ and the current zero crossing ZCR(i), and ratio A between Δ_s and Δ_a are calculated (step 145), and ratio A is compared to the value (r_P)/2 (step 146). If Δ≦(r_P)/2, then the tasks of left analysis edge $b_{sa}$ and left synthesis edge $b_{ss}$ are assigned to the current zero crossing (step 147), otherwise phase 15 (FIG. 11) of search continuation is started. The last comparison indicates that not only a sufficient distance between the left and right synthesis edge is required, but also that the connecting function takes into account the shortening in synthesis; this, too, helps obtaining a good connection between adjacent intervals.

Variable "TRUE" in the last step 147 in FIG. 14 indicates that $b_{sa}$ and $b_{ss}$ have been found and disables subsequent search phases. The same variable will also be utilized with the same meaning in the other flow charts related to the search for the left analysis and synthesis edges.

Step 14 allows finding a candidate, if any, that lies on the left of the right synthesis edge and is as close as possible to it, while guaranteeing a time interval sufficient to apply the connecting function. This step is the core of the criterion of the search for $b_{sa}$ and $b_{ss}$.

Figure 16:
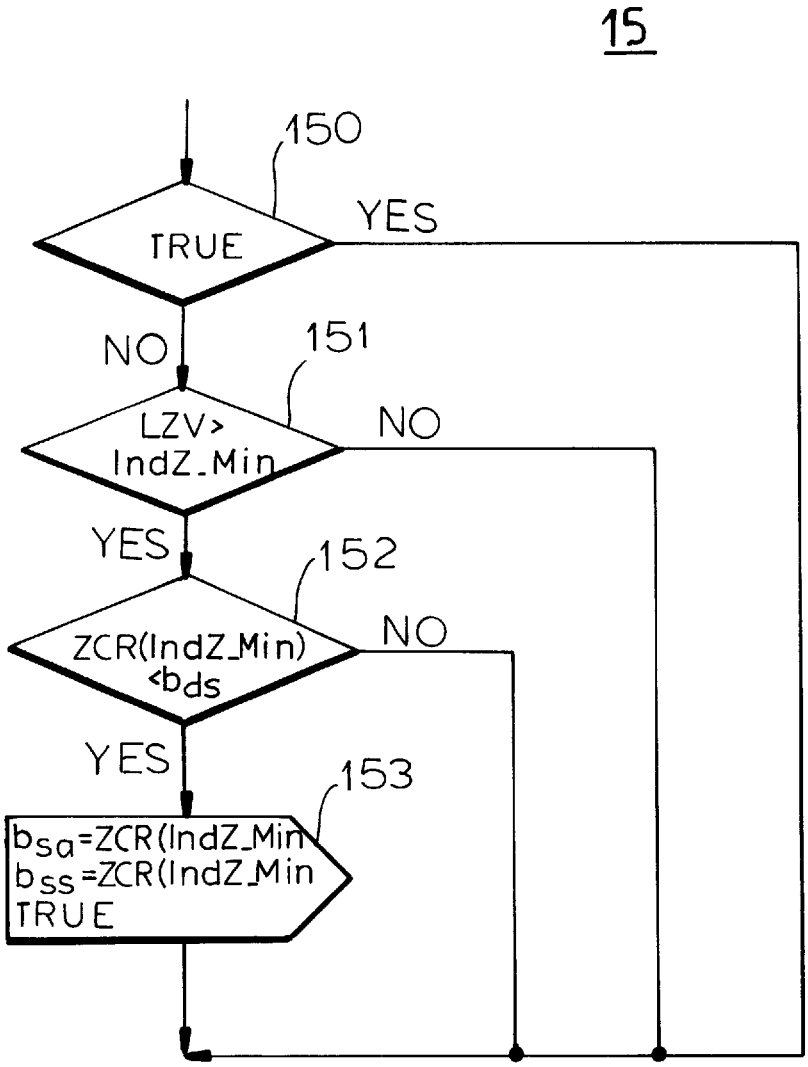

Search continuation step 15 is illustrated in detail in FIG. 16.

This step, if it is performed (negative result of phase 14 and therefore of the check on the TRUE condition in step 150), starts with a new comparison between LZV and IndZ_min (step 151), aimed now at just verifying whether LZV>IndZ_min. If the condition is not met, then step 17, of search continuation and conclusion is initiated. If LZV>IndZ_Min, then a check is made on whether the zero crossing having index IndZ_Min is positioned on the left of the right synthesis edge $b_{ds}$ (step 152). In the affirmative, this crossing is considered to be the left analysis edge $b_{sa}$ and left synthesis edge $b_{ss}$ (step 153). If instead the zero crossing having index IndZ_Min is still on the right of the right synthesis edge, then step 17 (FIG. 11) of search continuation and conclusion is initiated.

Figure 17:
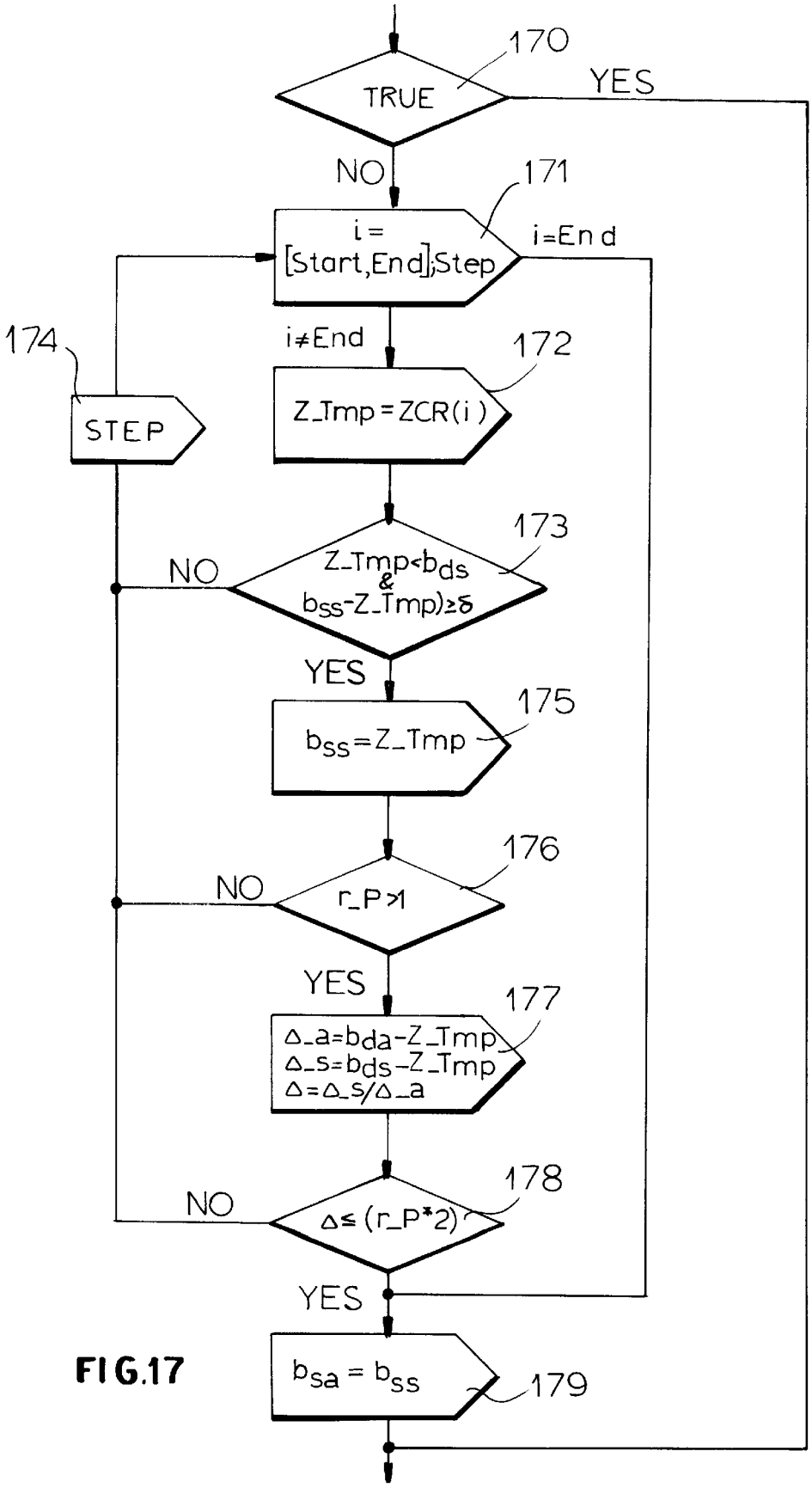

Search continuation and conclusion step 17 is represented in detail in FIG. 17. After checking the need to perform it (step 170), the zero crossings are reviewed again, in increasing index order. In the examination cycle (steps 171–174 in FIG. 17), a check is made at each step on whether the current zero crossing (indicated by Z_Tmp) is on the left of the right synthesis edge $b_{ds}$ and its distance from such edge is not lower than a predetermined minimum value δ, e.g. 10 signal samples (step 173). If the two conditions are not met, then the subsequent zero crossing is examined (step 174), otherwise this zero crossing is temporarily considered as the left synthesis and analysis edge (step 175) and the cycle is continued. The last zero crossing that meets condition 173 will be considered as the left synthesis and analysis edge (step 179). The check on r_P at step 176 is an additional means to distinguish between the case $p_s<p_a$ and the case $p_s>p_a$, and it causes steps 177 and 178 of the flow chart to be omitted in the case being examined.

Figure 18:
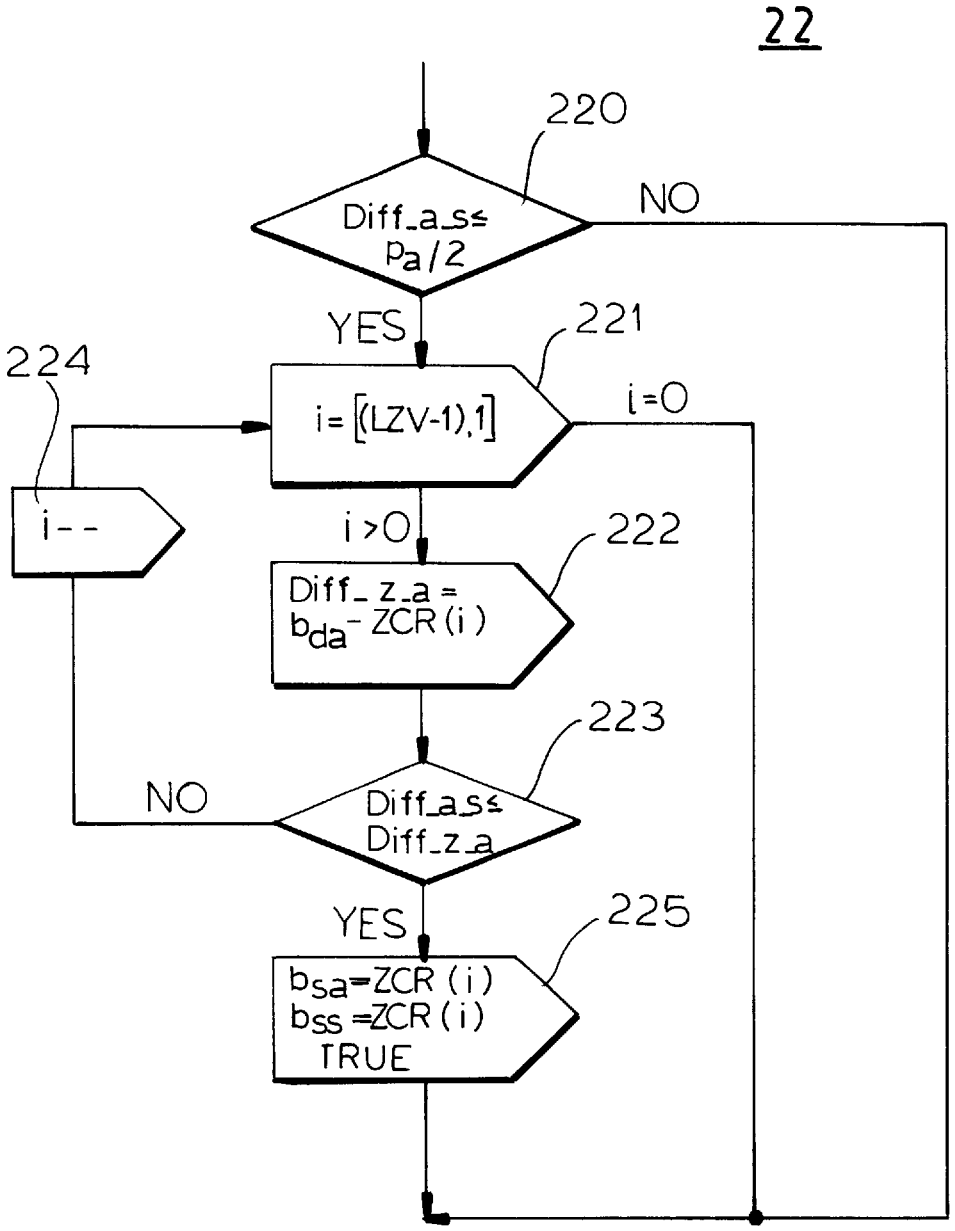

FIG. 18 illustrates the search for $b_{sa}$ and $b_{ss}$ when the synthesis period is lengthened with respect to the analysis period. This search starts with a comparison between the lengthening in synthesis Diff_a_s and half the duration of the analysis period Pa (step 220). If Diff_a_s>$p_a/2$, step 24 (illustrated in detail in FIG. 17) is started directly. If Diff_a_s≦$p_a/2$, a backward search cycle is carried out, starting from the zero crossing preceding LZV. Distance Diff_z_a between the right analysis edge $b_{da}$ and the current zero crossing ZCR(i) (steps 221, 222) is calculated and is compared with Diff_a_s (step 223): if it is smaller, then the search cycle continues (step 224), otherwise the current zero crossing is considered as the left analysis and synthesis edge (step 225).

If, at the end of the cycle, $b_{sa}$ and $b_{ss}$ have not been determined, then the phase of search continuation and conclusion is initiated (phase 24, FIG. 12).

If the lengthening required in synthesis is less than or equal to half the analysis period, the operations described above allow finding a candidate, if any, that is the first for which the distance from the right analysis edge exceeds or is equal to the required lengthening.

In the search continuation and conclusion phase, a backward search cycle is carried out, as stated, starting from the zero crossing preceding LZV, with the procedures illustrated in steps 171–175 in FIG. 17. Moreover, since a lengthening of the interval is considered (step 176), distance Δ_a between the right analysis edge $b_{da}$ and the current zero crossing Z_Tmp, distance A_s between the right synthesis edge $b_{ds}$ and the current zero crossing Z_Tmp and ratio Δ between these distances are computed (step 177) for the zero crossings that meet the conditions of step 173. Ratio Δ is compared with twice the ratio between the periods (r_P*2) for the same reasons seen for comparison 146 in FIG. 15, and the zero crossing that meets the condition Δ≦(r_P*2) will be taken as left analysis edge $b_{sa}$ and left synthesis edge $b_{ss}$.

The conditions imposed in this phase allow assigning the task of left analysis edge to a zero crossing that lies on the left of the right synthesis edge, is as close as possible to it and also guarantees a sufficient time interval for the connecting function be applied: in particular, given a certain analysis period, a left analysis edge positioned farther back in the original period will correspond to a greater lengthening required in synthesis.

The method described herein can be performed by means of a conventional personal computer, workstation, or similar apparatus.

It is evident that what is described above is given by way of non-limiting example and that variations and modifications are possible without departing from the scope of the invention.

We claim:

1. A method for speech signal synthesis by means of time concatenation of waveforms representing elementary speech signal units, which comprises the steps of:

(a) subdividing at least the waveforms associated with voiced sounds into a plurality of waveform intervals, corresponding to the responses of the vocal duct to a series of impulses of vocal cord excitation, synchronous with a fundamental frequency;

(b) weighting each waveform interval to produce signals;

(c) replacing the signals produced from the weighting of the waveform intervals upon subdivision thereof with a replica shifted in time by an amount depending on a prosodic information; and (d) synthesizing a speech signal by overlapping and adding the shifted replica, and wherein step (d) comprises:

(1) subdividing a current interval of an original speech signal to be reproduced in synthesis into an unchanging part, which lies between an interval beginning and a left analysis edge represented by a zero crossing of the original speech signal which meets predetermined conditions, and a variable part, which lies between the left analysis edge and a right analysis edge that essentially coincides with the end of the current interval, the left and right analysis edges being associated, in the synthesized signal, respectively with a left synthesis edge and a right synthesis edge, of which the former coincides with the left analysis edge, with reference to a start-of-interval marker, and the latter coincides with the end of the interval in the synthesized signal;

(2) applying a first connecting function on a part of a waveform subdivision on the right of the left analysis edge of the current interval of the original signal, which function has a duration equal to that of a segment of synthesized waveform lying between the left and right synthesis edges and an amplitude that progressively decreases and is maximum in correspondence with the left analysis edge;

(3) applying a second connecting function on a part of a waveform subdivision on the left of a subsequent interval of the original signal to be reproduced in synthesis, which function has a duration equal to that of a segment of synthesized waveform lying between the left and right synthesis edges and an amplitude that progressively increases and is maximum in correspondence with the beginning and said subsequent interval; and (4) building each interval of synthesized signal by reproducing unchanged the waveform in the unchanging part of the original interval and by joining thereto the waveform obtained by aligning in time and adding the two waveforms resulting from applying the two connecting functions, upon a duration of an interval being reduced or maintained unchanged for the synthesis with respect to the duration of a corresponding interval of the original speech signal, the left analysis edge and the left synthesis edge being determined by the following operations:

(i) computing the number of zero crossings of a waveform of the original speech signal and assigning each zero crossing an index, increasing from the beginning towards the end of the interval;

(ii) checking that the number of zero crossings is not lower than a first threshold;

(iii) searching, in case of a positive outcome of the checking, for a zero crossing candidate to act as left analysis and synthesis edge; and (iv) backwards searching, among all zero crossings in the interval, except the last one, for a candidate that lies on the left of the right synthesis edge, is as close as possible to it and guarantees a time interval sufficient for the connecting functions to be applied, and assigning the task of left analysis and synthesis edge to this candidate.

2. The method defined in claim 1 wherein in said computing of the number of zero crossings in step (i), zero crossings whose distances from a previous zero crossing is lower than a predetermined distance are disregarded.

3. The method defined in claim 1 wherein upon a negative result of the backwards searching and determination of a number of zero crossings higher than the first threshold, assigning tasks of left analysis edge and left synthesis edge to a zero crossing whose index corresponds to said threshold, if such a zero crossing lies on the left of the right synthesis edge.

4. The method defined in claim 1 wherein upon a negative result of the backwards searching and determination of a number of zero crossings not higher than the first threshold, a further search phase is carried out to identify zero crossings lying on the left of the right synthesis edge and having a distance from the latter that is not lower than a second threshold, and the tasks of left analysis edge and right analysis edge are assigned to the highest index zero crossing which meets these conditions.

5. The method defined in claim 4 wherein upon a comparison with the first threshold indicating that the number of zero crossings is lower than the first threshold, said backwards search is performed directly and, upon a negative result, said further search phase is performed directly.

6. A method for speech signal synthesis by means of time concatenation of waveforms representing elementary speech signal units, which comprises the steps of:

(a) subdividing at least the waveforms associated with voiced sounds into a plurality of waveform intervals, corresponding to the responses of the vocal duct to a series of impulses of vocal cord excitation, synchronous with a fundamental frequency;

(b) weighting each waveform interval to produce signals;

(c) replacing the signals produced from the weighting of the waveform intervals upon subdivision thereof with a replica shifted in time by an amount depending on a prosodic information; and (d) synthesizing a speech signal by overlapping and adding the shifted replica, and wherein step (d) comprises:

(1) subdividing a current interval of an original speech signal to be reproduced in synthesis into an unchanging part, which lies between an interval beginning and a left analysis edge represented by a zero crossing of the original speech signal which meets predetermined conditions, and a variable part, which lies between the left analysis edge and a right analysis edge that essentially coincides with the end of the current interval, the left and right analysis edges being associated, in the synthesized signal, respectively with a left synthesis edge and a right synthesis edge, of which the former coincides with the left analysis edge, with reference to a start-of-interval marker, and the latter coincides with the end of the interval in the synthesized signal;

(2) applying a first connecting function on a part of a waveform subdivision on the right of the left analysis edge of the current interval of the original signal, which function has a duration equal to that of a segment of synthesized waveform lying between the left and right synthesis edges and an amplitude that progressively decreases and is maximum in correspondence with the left analysis edge;

(3) applying a second connecting function on a Dart of a waveform subdivision on the left of a subsequent interval of the original signal to be reproduced in synthesis, which function has a duration equal to that of a segment of synthesized waveform lying between the left and right synthesis edges and an amplitude that progressively increases and is maximum in correspondence with the beginning and said subsequent interval; and (4) building each interval of synthesized signal by reproducing unchanged the waveform in the unchanging part of the original interval and by joining thereto the waveform obtained by aligning in time and adding the two waveforms resulting from applying the two connecting functions, upon a duration of the interval being increased for the synthesis compared to the duration of the corresponding interval of the original signal, the left analysis edge and the right synthesis edge being determined with the following operations:

(i) computing a number of zero crossings of the original signal waveform;

(ii) comparing a duration lengthening of the synthesis interval and the duration of the original interval, to check that the lengthening does not exceed half the original interval duration; and (iii) if the check in step (ii) yields a positive result, searching backwards, among all the zero crossings except the last one, for a candidate zero crossing that lies on the left of the right synthesis edge and is the first for which the distance from the right synthesis edge is not shorter than the lengthening of the interval duration, the tasks of left analysis edge and left synthesis edge being assigned to any zero crossing that meets said condition.

7. The method defined in claim 6 wherein in the computing of the number of zero crossings in step (i), crossings whose distance from a previous crossing is lower than a predetermined distance are disregarded.

8. The method defined in claim 6 wherein, upon an interval duration lengthening exceeding half an original interval duration or upon the backwards search being unsuccessful, a further backwards search phase is carried out to identify the zero crossings lying on the left of the right synthesis edge and having a distance from the latter that is not lower than a third threshold; the distances from the right synthesis edge and from the right analysis edge and the ratio between these distances is computed for such zero crossings; said ratio is compared with the value of the ratio between the duration of the synthesis interval and the duration of the original interval, and the tasks of left analysis edge and left synthesis edge are assigned to the zero crossing whose index is the lowest among those for which the ratio between the distances from the right synthesis and analysis edges does not exceed by a predetermined factor the ratio between durations.

* * * * *

UNITED STATES PATENT AND TRADEMARK OFFICE
CERTIFICATE OF CORRECTION

PATENT NO: 5,774,855
DATED : 30 June 1998
INVENTORS: Enzo FOTI et al

It is certified that error appears in the above-identified patent and that said Letters Patent is hereby corrected as shown below:

Title page, Item [54] (TITLE) should be corrected to read:

-- METHOD OF SPEECH SYNTHESIS BY MEANS OF CONCATENATION AND PARTIAL OVERLAPPING OF WAVEFORMS --.

Column 1, lines 1 - 4, (TITLE) should be corrected to read:

-- METHOD OF SPEECH SYNTHESIS BY MEANS OF CONCATENATION AND PARTIAL OVERLAPPING OF WAVEFORMS --.

Signed and Sealed this

Twenty-ninth Day of December, 1998

*Attest:*

*Attesting Officer*

BRUCE LEHMAN

*Commissioner of Patents and Trademarks*